US010874592B2

(12) United States Patent
Pyka

(10) Patent No.: US 10,874,592 B2
(45) Date of Patent: Dec. 29, 2020

(54) APPARATUS AND METHOD FOR MEASURING LIQUID CONSUMPTION DURING INFANT FEEDING

(71) Applicant: Justin Pyka, Coconut Creek, FL (US)

(72) Inventor: Justin Pyka, Coconut Creek, FL (US)

( * ) Notice: Subject to any disclaimer, the term of this patent is extended or adjusted under 35 U.S.C. 154(b) by 243 days.

(21) Appl. No.: 16/015,176

(22) Filed: Jun. 21, 2018

(65) Prior Publication Data

US 2019/0015299 A1 Jan. 17, 2019

Related U.S. Application Data

(60) Provisional application No. 62/531,876, filed on Jul. 13, 2017.

(51) Int. Cl.
*A61J 9/06* (2006.01)
*B67D 3/00* (2006.01)

(52) U.S. Cl.
CPC ..... *A61J 9/063* (2015.05); *A61J 9/06* (2013.01); *A61J 9/0676* (2015.05); *A61J 2200/72* (2013.01); *A61J 2200/74* (2013.01); *A61J 2200/76* (2013.01); *B67D 3/0041* (2013.01); *B67D 3/0077* (2013.01)

(58) Field of Classification Search
CPC .. A61J 9/063; A61J 9/0676; A61J 9/06; A61J 9/02; A61J 9/04; A61J 9/00
See application file for complete search history.

(56) References Cited

U.S. PATENT DOCUMENTS

| | | | | |
|---|---|---|---|---|
| 5,339,548 | A | 8/1994 | Russell | |
| 8,413,502 | B2 | 4/2013 | Zemel et al. | |
| 9,061,813 | B2 | 6/2015 | Steininger | |
| 2008/0203049 | A1* | 8/2008 | Goldberg | A61J 9/00 215/11.1 |
| 2011/0029262 | A1 | 2/2011 | Barkhouse | |
| 2011/0087078 | A1* | 4/2011 | Zemel | A61J 9/00 600/300 |
| 2012/0302924 | A1* | 11/2012 | Cunningham | A61B 5/228 600/590 |
| 2013/0153527 | A1* | 6/2013 | Lau | A61J 9/04 215/11.5 |
| 2014/0138404 | A1 | 5/2014 | Swiegot et al. | |
| 2014/0190357 | A1 | 7/2014 | Mak | |

(Continued)

FOREIGN PATENT DOCUMENTS

| | | | |
|---|---|---|---|
| CN | 104382742 | A | 3/2015 |
| CN | 105640781 | A | 6/2016 |

(Continued)

*Primary Examiner* — Helen C Kwok
(74) *Attorney, Agent, or Firm* — Allen F. Bennett; Bennett Intellectual Property

(57) ABSTRACT

A device for measuring in real time the volume of a partially upturned bottle has a sleeve that extends around the upturned bottle with an open distal end and a closed proximal end. An accelerometer in the device determines the vertical direction and the angle between the vertical direction and the longitudinal axis of the bottle. Another accelerometer measures the force exerted by the bottle in the direction of the longitudinal axis. These parameters are used to calculate the total mass and volume of the upturned bottle. A dimmable screen displays the total mass, total volume, change in mass and/or change in volume.

10 Claims, 6 Drawing Sheets

(56) References Cited

U.S. PATENT DOCUMENTS

| | | | | |
|---|---|---|---|---|
| 2014/0242213 | A1* | 8/2014 | McCarty | A61J 15/0011 426/2 |
| 2015/0196247 | A1* | 7/2015 | Lau | G01F 1/363 600/301 |
| 2015/0208979 | A1* | 7/2015 | Cunningham | A61B 5/682 600/590 |
| 2016/0025545 | A1 | 1/2016 | Saltzgiver et al. | |
| 2018/0197629 | A1* | 7/2018 | Zhou | A61J 9/001 |
| 2018/0220955 | A1* | 8/2018 | Cunningham | A61J 11/00 |
| 2019/0021548 | A1* | 1/2019 | Eisner | A47J 43/042 |
| 2019/0096224 | A1* | 3/2019 | Shoham | G08B 21/182 |
| 2019/0125630 | A1* | 5/2019 | Van Kollenburg | A61J 9/02 |
| 2019/0298615 | A1* | 10/2019 | Wood | A47G 19/2227 |

FOREIGN PATENT DOCUMENTS

| | | | | |
|---|---|---|---|---|
| CN | 105943399 | A | 9/2016 | |
| CN | 205649656 | U | 10/2016 | |
| CN | 106074173 | A | 11/2016 | |
| WO | 2012156509 | A2 | 11/2012 | |
| WO | WO-2018122173 | A1 * | 7/2018 | A61J 9/06 |

* cited by examiner

APPARATUS AND METHOD FOR MEASURING LIQUID CONSUMPTION DURING INFANT FEEDING

CROSS-REFERENCE TO RELATED APPLICATIONS

This application claims priority to U.S. Provisional Application Ser. No. 62/531,876 filed on Jul. 13, 2017, the contents of which are hereby incorporated in their entirety.

STATEMENT REGARDING FEDERALLY SPONSORED RESEARCH OR DEVELOPMENT

Not Applicable.

THE NAMES OF PARTIES TO A JOINT RESEARCH AGREEMENT

Not Applicable

INCORPORATION-BY-REFERENCE OF THE MATERIAL SUBMITTED ON A COMPACT DISC

Not Applicable.

COPYRIGHT NOTICE

Not Applicable

BACKGROUND OF THE INVENTION

Field of the Invention

The present invention relates to a method and apparatus for monitoring liquid consumption during feeding of an infant. More particularly, the present invention relates to devices and systems for measuring the amount of liquid consumed by an infant during feeding by measuring the change in mass of the baby bottle.

Description of the Related Art

A wide variety of methods are known for measuring changes in volume of a fluid in a container. Some containers include electronics to automatically track consumption of liquids stored within the containers. For example, some gas tanks include electronic sensors that monitor the amount of gasoline in the gas tank, tracking both the addition of liquid to the tank, and consumption of liquid from the tank. Similar sensors are often used in industrial applications, for example, tracking use of chemicals in industrial processes. In some cases, such sensors have been used to track liquid consumption from portable hand-held containers of liquids, like water bottles.

There are numerous situations in which monitoring changes in volume of a liquid is highly desirable. One common situation experienced by almost everyone is the monitoring of consumption of a newborn or very young child. New parents often track the amount of milk or formula consumed and the time intervals between feedings of a young baby. As a result, most baby bottles are graduated so that the volume within them may be determined by placing them upright on a flat surface and comparing the height of the liquid with the demarcations along the side of the bottle. This is a less than satisfactory method when feeding a baby late at night. It is often desirable to feed a baby with very little lighting so that the baby does not fully awaken when feeding in the early morning hours. This makes measuring the volume of milk or formula in a bottle more difficult because it is harder to see. In addition, measuring the volume consumed during feeding requires removing the bottle from the baby's mouth and placing it on a level surface, then placing it back in the baby's mouth. This constant disruption makes feeding more difficult. It would be much more practical and easier if there were a means of measuring a baby's consumption in real time during feeding.

Some devices of been developed which measure the amount of fluid or pressure through a conduit within the nipple of a baby bottle. However, these methods are in accurate in part because of the nipple mechanism. Air and liquid both travel through the nipple which both causes changes in pressure as well as changes in the volume of liquid transferred through the nipple. Another substantial drawback to these devices is that they are typically sensitive and have relatively delicate mechanisms and electronics that are not well suited for the repeated sterilization processes which baby bottles often are exposed to.

There remains a need for a device that can conveniently and accurately measure an infant's consumption during feeding. Additionally, there remains a need for a measuring device that can be easily disassembled, cleaned, and reassembled.

The above-described deficiencies of today's systems are merely intended to provide an overview of some of the problems of conventional systems, and are not intended to be exhaustive. Other problems with the state of the art and corresponding benefits of some of the various non-limiting embodiments may become further apparent upon review of the following detailed description.

In view of the foregoing, it is desirable to provide a means for accurately measuring the volume of liquid consumed through a baby bottle. It is also desirable to provide a means for notifying a caregiver of the volume consumed in real time in a manner that does not require substantial ambient light.

BRIEF SUMMARY OF THE INVENTION

Disclosed is A device for measuring in real time the volume of a partially upturned bottle has a sleeve that extends around the upturned bottle with an open distal end and a closed proximal end. An accelerometer in the device determines the vertical direction and the angle between the vertical direction and the longitudinal axis of the bottle. Another accelerometer measures the force exerted by the bottle in the direction of the longitudinal axis. These parameters are used to calculate the total mass and volume of the upturned bottle. A dimmable screen displays the total mass, total volume, change in mass and/or change in volume.

In one embodiment, A device for measuring the change in volume of a baby bottle during feeding has a sleeve configured to fit over a baby bottle having an open distal end and a longitudinal axis. An annular cuff is affixed to a baby bottle inside the sleeve. A scale or other device is connected to the annular cuff and measures the force exerted by the bottle on the cuff. An integrated accelerometer is configured to determine vertical direction and the angle between the longitudinal axis of the sleeve and the vertical direction. A microcircuit determines the mass of the bottle in the sleeve from the values of the angle between the longitudinal axis of the sleeve and the vertical direction and the force exerted by the bottle on the cuff. An LED screen in electrical communication with the microcircuit for displays the mass and/or the change in mass of the bottle in the sleeve. The LED brightness of the screen may be modulated. A battery for supplies electricity to the components of the device.

It is therefore an object of the present invention to provide a device for displaying the amount of volume or mass removed from the bottle in real time using a display screen that may be dimmed.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE SEVERAL VIEWS OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
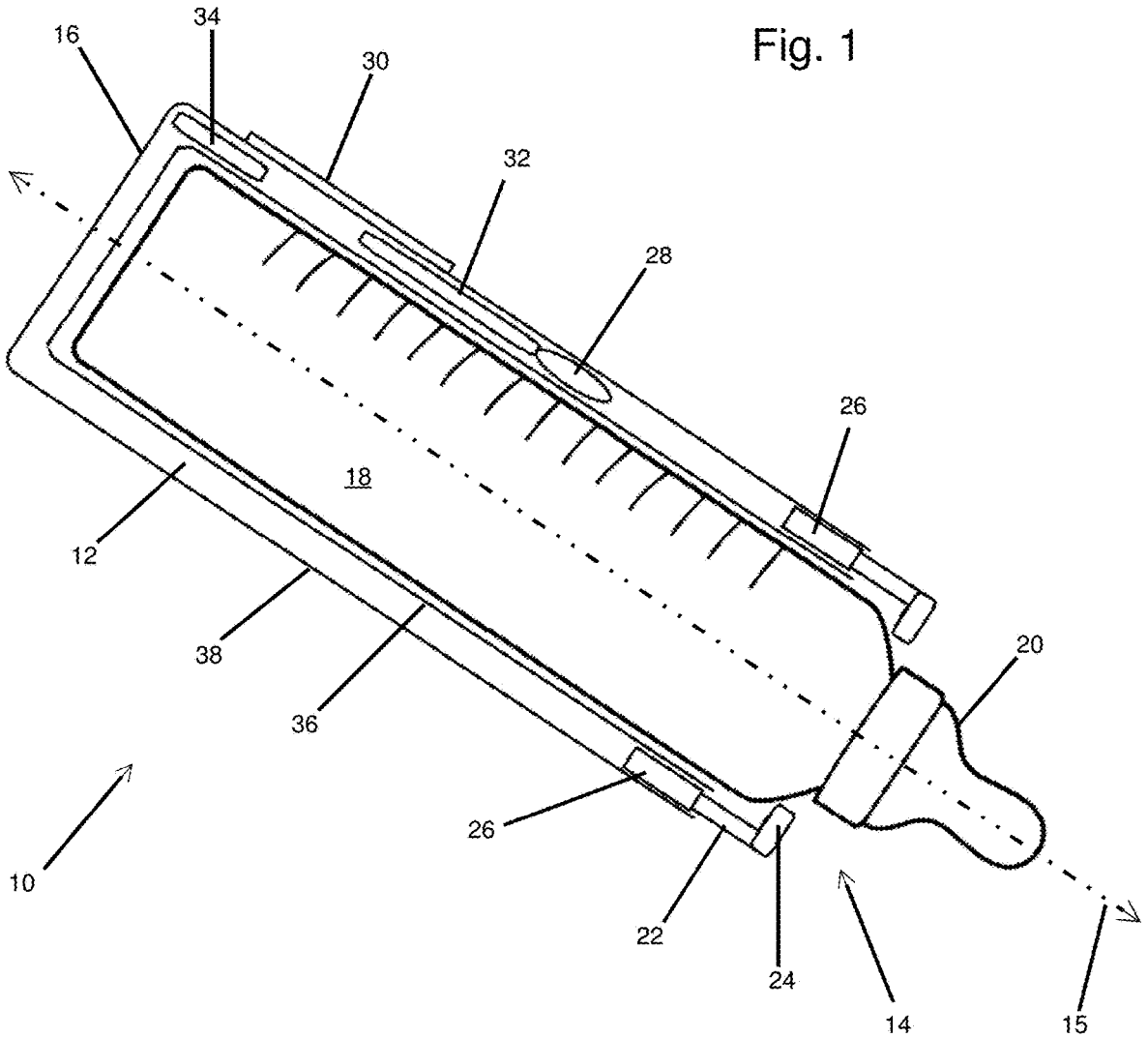
FIG. 1 is a cross-sectional view of a consumption measuring device in accordance with the principles of the invention.

The invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

The disclosed subject matter is described with reference to the drawings, wherein like reference numerals are used to refer to like elements throughout. In the following description, for purposes of explanation, numerous specific details are set forth in order to provide a thorough understanding of the various embodiments of the subject disclosure. It may be evident, however, that the disclosed subject matter may be practiced without these specific details. In other instances, well-known structures and devices are shown in block diagram form in order to facilitate describing the various embodiments herein.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form.

Disclosed is a method and device for monitoring in real time he consumption of liquid in a baby bottle while feeding a baby. The device and method can be used with any standard baby bottle. The device attaches to a baby bottle in a manner that allows it to measure the force exerted by gravity on the bottle in the direction of the bottles longitudinal axis. The device also measures the angle at which the bottle is tilted. From these two parameters, a small computer chip calculates the total weight of the bottle. The device also includes a screen that displays either the calculated weight or the calculated change in weight. Optionally, the device may calculate the volume of liquid in the bottle from the weight, and may display the volume or change in volume. The device also has a temperature gauge for monitoring the temperature of the contents of the bottle. The screen is a lit digital display that shows the temperature and volume of the liquid in the bottle that may be dimmable to reduce the light output by the screen and may also display numbers and characters in a lit font whose brightness may be adjustable.

During use, an empty bottle may be placed within the device, and the devices then tilted so that the device can measure the weight of an empty bottle to act as a tare value. This value can be entered as another parameter for the microcircuits. The bottle may then be filled to a specific volume and placed within the device so that the device may calculate the mass and volume of a full bottle. If there is a discrepancy, an operator can use this method to calibrate the device to improve accuracy. Once the bottle is calibrated, a baby may be fed while the bottle is contained within the device. As the baby consumes liquid from the bottle, the force measured by the device changes, allowing the device to calculate the change in weight and/or volume while the baby feeds. These amounts may be displayed on the screen. An operator may thus monitor the amount consumed by a baby instantaneously in real time. If the operator desires to feed a baby a specific amount, he or she will know the moment that volume has been reached. By using this device, it is unnecessary to remove the bottle and place it on a flat surface to determine the amount of liquid consumed.

Optionally, an operator may choose to forego calibrating the device and simply insert a full bottle into the device. The device will then calculate the volume and/or mass within the bottle and display the change in volume or mass while the baby feeds. This method may be less accurate but nonetheless allows an operator to monitor the change in volume of the liquid within the bottle. The invention as described herein as used when feeding a baby. However, those skilled in the art will appreciate that the invention may be utilized to accurately measure changes in volume of any bottle that is rotated such that its space does not lie on a flat horizontal surface. The invention may also be utilized in the feeding of various animals.

Optionally, the device is capable of sending wireless transmissions to a smartphone, tablet or computer and can include an "app" for recording data relating to the amount of consumption, the speed of consumption and the temperature of the liquid. The invention may also include a timer which notifies an operator if a bottle has been exposed too long and a new sterile bottle should be used to replace it. The device may be configured for use with a bottle custom fit to the device that may be removed from the device and cleaned and/or sterilized using a dishwasher, microwave, stove and the like.

FIG. 1 shows an exemplary embodiment of a baby bottle consumption measuring device 10 for measuring the consumption of liquid during feeding in accordance with the principles of the invention. The device 10 includes an elongate sleeve 12 radially symmetric about a longitudinal axis 15 and having an open distal end 14, and a closed proximal end 16 that functions as a base when the device 10 is not in use. The sleeve 12 is configured to accommodate a typical baby bottle 18 such that the nipple 20 and optionally the top of the bottle protrude through the open distal end 14. The device 10 includes an annular cuff 22 that extends out of sleeve 12 at the distal end 14 and has an inward flange 24 configured to engage the top of the bottle 18. FIG. 1 is a cross-sectional view but it should be understood that the sleeve 12 is cylindrical. The annular cuff 22 may be continuous or may optionally be formed from a plurality of rods or other extensions and a radially symmetric manner. The flange 24 is preferably annular in continuous. Such a configuration allows the device 10 and the bottle 18 to be held in any orientation without affecting the accuracy of measurements made by the device 10.

The sleeve 12 includes integral components. Inside the sleeve 12 and connected to the cuff 22 is a measuring device such as a scale 26 for measuring the force exerted against the flange 24 by the impinging of the bottle 18 upon it. Preferably, as explained above, the scale is capable of accurately measuring the force exerted by the bottle regardless of rotation about its longitudinal axis 15. The device 10 also includes an accelerometer 28 that detects the direction of gravity. A display screen 30 on the exterior of the sleeve 12 displays various information. The sleeve 12 also includes a microcircuit 32 and a battery 34 that provides power to the various components.

Figure 2:
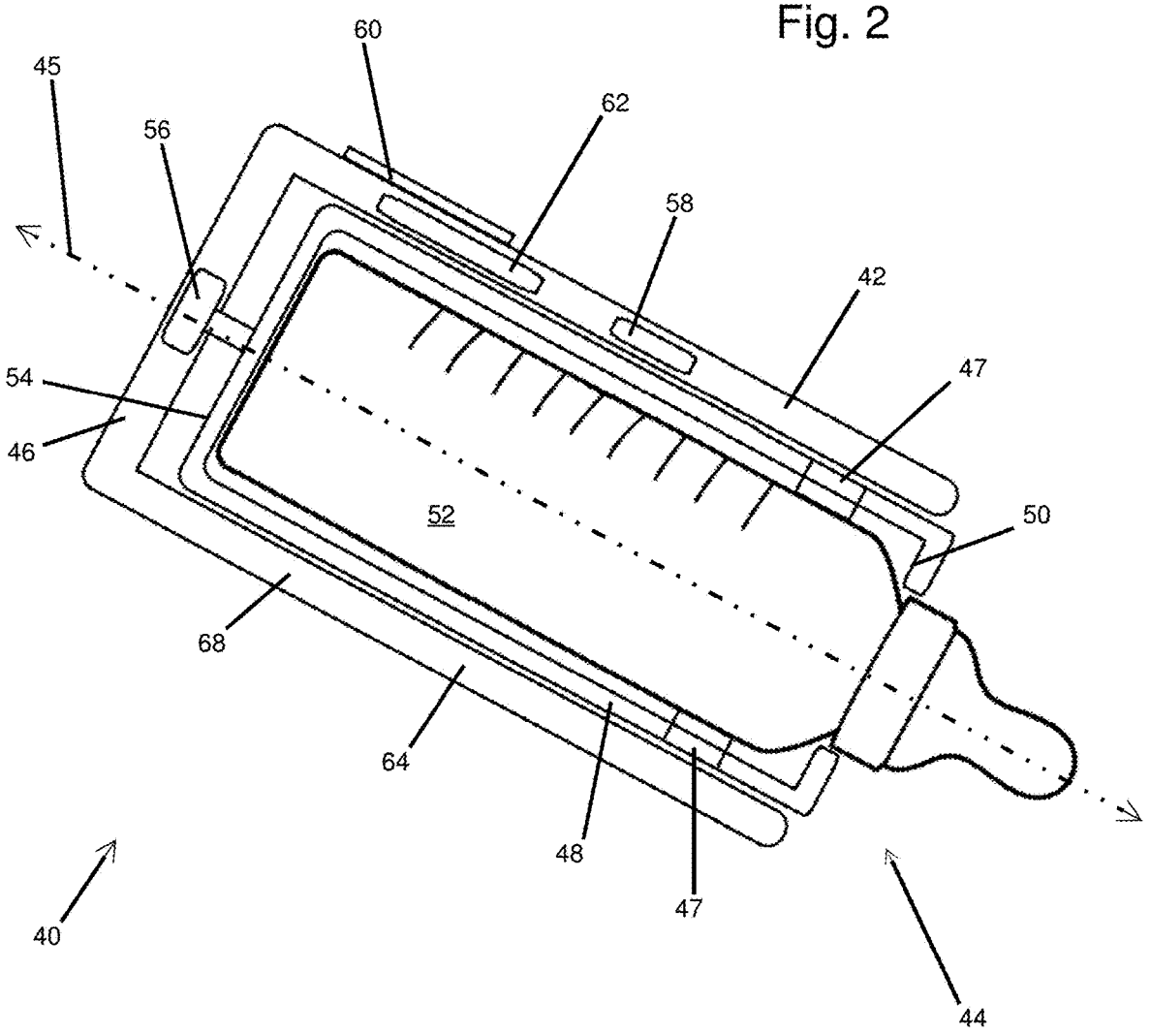
FIG. 2 is a cross-sectional view of an alternative embodiment of a consumption measuring device in accordance with the principles of the invention.

The microcircuit 32 receives information from the scale 26 and the accelerometer 28 and uses it to calculate the total mass of the bottle and its contents. Engineers and other skilled artisans will appreciate that calculating the mass of an object by measuring the force it exerts in the direction of gravity and the angle between the direction of the force and the source of gravity is a well known and understood calculation. Calculating the volume of a known liquid based upon its total mass is also a well-known calculation. In this embodiment, it is preferable that the inside wall 36 of the sleeve 12 is smooth and causes very little static friction upon the bottle 18. The outer wall 38, on the other hand, preferably has a surface that allows an operator to easily grasp the device 10. For example, the outer wall 38 may include grooves to accommodate fingers, a textured surface, a rubber or other high friction surface or the like. The display screen may be used to display the mass or volume FIG. 2 shows an alternative embodiment of a baby bottle consumption measuring device 40 in accordance with the principles of the invention. The device 40 includes an outer sleeve 42 symmetric about a longitudinal axis 45 having an open distal end 44 and a closed proximal end 46 that may be used as a base when the device is not used during feeding of an infant. This embodiment includes a second interior sleeve 48 configured to accommodate a typical baby bottle. The interior sleeve 48 includes an inward facing flange 50 that abuts a bottle 52 removably housed within the device 40. The proximal end 54 of the interior sleeve 48 is attached to an accelerometer 56 that measures the force exerted by the bottle 52 against the flange 50 during use. Those skilled in the art will appreciate that a scale use for measuring weight is a type of accelerometer. The outer sleeve 42 has an integrated accelerometer 58, a display screen 60, a microcircuit 62, a communication device 64 and a battery 68. As with the embodiment shown in FIG. 1, the accelerometers 56 and 58 provide data to the microcircuit 62 that allows it to display information relating to the mass, volume, change in mass and/or change in volume of the bottle during feeding.

The communication device 64 may be a Bluetooth® transmitter, a Wi-Fi transmitter, a USB port or other device capable of transferring information from the device 40 to another device such as a smart phone, tablets or computer. It may be desirable to utilize a phone app that receives information from the device 40 to provide a record of feeding times and amounts.

The device 40 also includes a temperature gauge 47 configured as an annular ring that comes into contact with the bottle so that the temperature of the bottle and its contents may be measured and recorded. If the temperature gauge 47 forms a sufficient friction fit to the bottle, the flange 50 is unnecessary.

Figure 3:
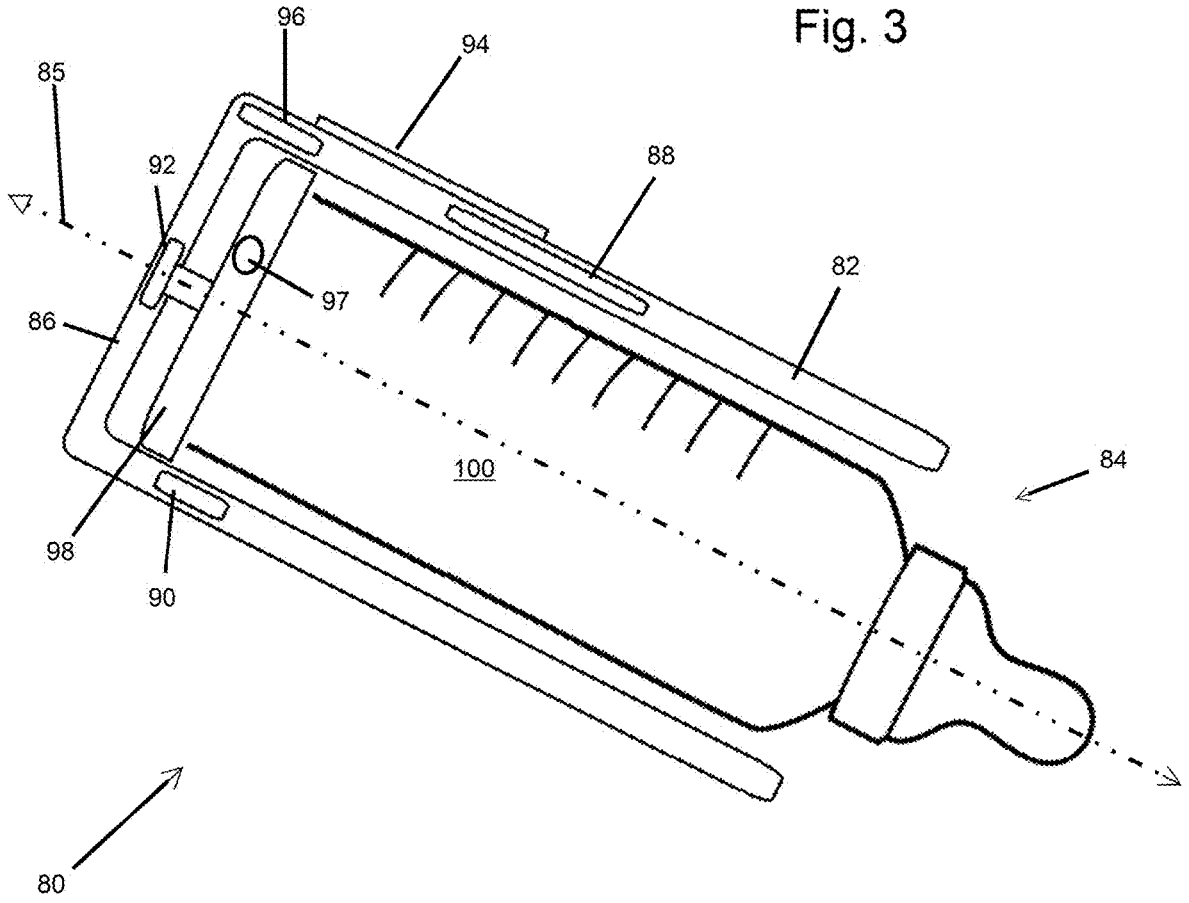
FIG. 3 is a cross-sectional view of another alternative embodiment of a consumption measuring device in accordance with the principles of the invention.

FIG. 3 shows another alternative embodiment of a consumption measuring device 80 in accordance with the principles of the invention. The device 80 has a longitudinal axis 85, a sleeve 82 having an open distal end 84 and a closed proximal end 86. The device includes a microcircuit 88, and accelerometer 90, a scale 92, a display screen 94 and a battery 96. In this embodiment, an internal socket 98 is connected to the scale 92 and is removably attachable to the bottom of a typical baby bottle 100. This embodiment allows measuring volumes during consumption from baby bottles having different lengths. A temperature gauge 97 in the socket 98 is in contact with the bottle and may record the temperature of the bottle, and the change in temperature over time.

Figure 4:
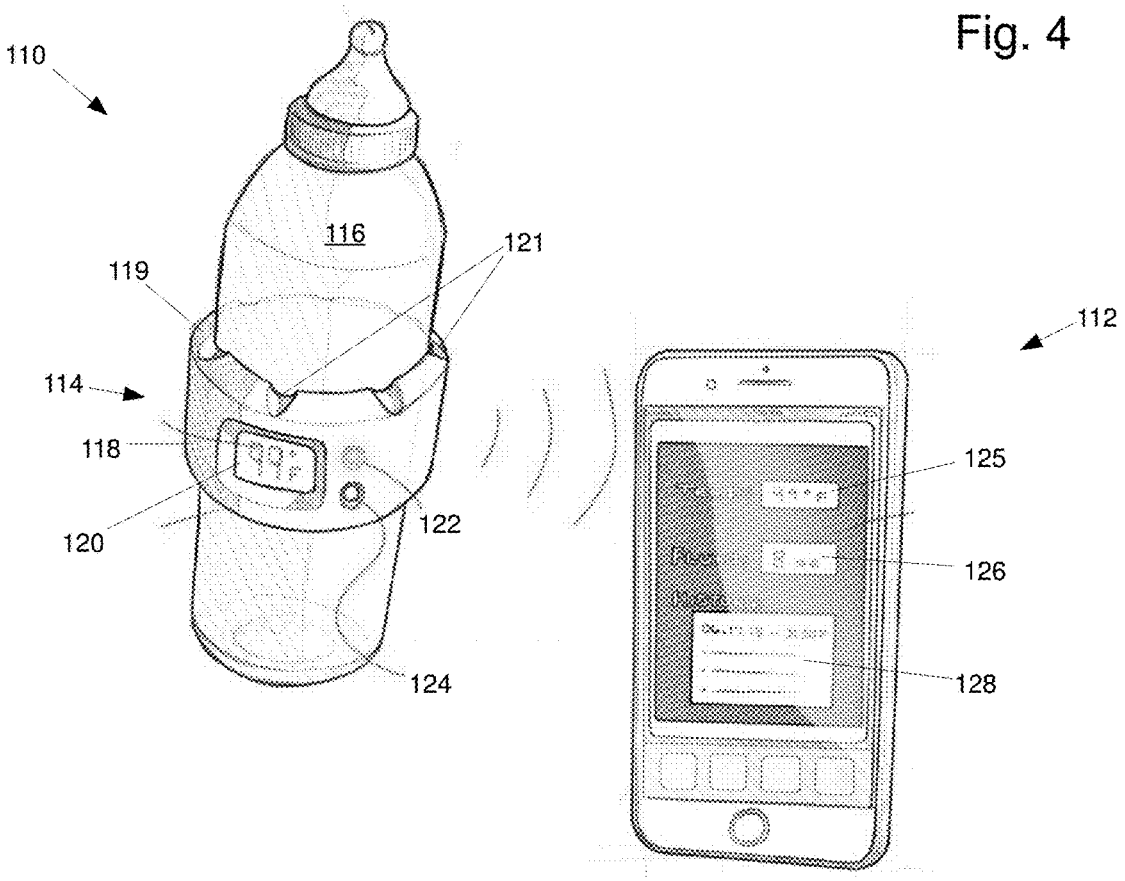
FIG. 4 is a perspective view of a liquid measuring device and wirelessly connected electronic device in accordance with the principles of the invention.

FIG. 4 shows an alternative embodiment of a liquid measuring device for a baby bottle 110 in wireless communication with an electronic device 112 in accordance with principles of the invention. The liquid measuring device 110 of this embodiment has an annular body 114 configured to fit around a typical baby bottle 116. The outer wall 118 of the annular body 114 is substantially cylindrical and includes a self-illuminating digital display 120. The body 114 includes a beveled upper wall 119 having a plurality of grooves 121. A beveled lower wall 126, shown in FIG. 5, similarly has a plurality of grooves. The self-illuminating digital display 120 may be backlit or the digits in the readout may themselves be lit. The outer wall 118 of the annular body 114 also includes a green LED light 122 and a red LED light 124. The self-illuminating digital display 120 is used to display the temperature of liquid within the baby bottle 116, or alternatively, the amount of liquid within the bottle 116. The amount of liquid may be measured by volume, weight or both.

The liquid measuring device 110 is in wireless communication with an electronic device 112 which in this embodiment is a smart phone. Optionally, the electronic device may be a tablet, a laptop, a smart watch or other similar device. In this embodiment, the liquid measuring device 110 communicates with the electronic device 112 via a Bluetooth® connection. The electronic device 112 has customized software, commonly known as a "phone app," that displays the temperature 125 and amount of liquid 126 remaining within the bottle 116. As feeding of an infant progresses, the change in amount of liquid is communicated to the electronic device 112 in real time and the amount of liquid remaining within the bottle 116 is continuously updated. Similarly, the temperature is constantly monitored and any changes are displayed on the electronic device.

The liquid measuring device 110 will connect through wifi or bluetooth® to the user's smart phone to communicate to the iPhone or Android application informing the user exactly when the feeding occurred and the volume the baby drank. The application will also graph these figures to compare it to the daily requirements or recommendations from a creditable website. If the milk is not an ideal temperature that the LED screen will illuminate red and if the temperature is correct to illuminate green.

Those skilled in the art will appreciate that a phone app type of software may be designed to provide a variety of additional information. For example, in this embodiment, the electronic device displays historical information 128 such as the amount of liquid consumed on prior occasions, the time at which those prior occasions took place, the amount of time over which the liquid was consumed and the temperature of the liquid during those prior occasions. In addition, the amount of liquid displayed may be either the amount of liquid remaining within the bottle or the amount consumed. The phone app software may optionally perform a variety of types of statistical and data analysis such as determining average amounts of consumption and average time between feedings. The phone app may also optionally include an alarm to alert a caregiver to upcoming feeding times.

Figure 5:
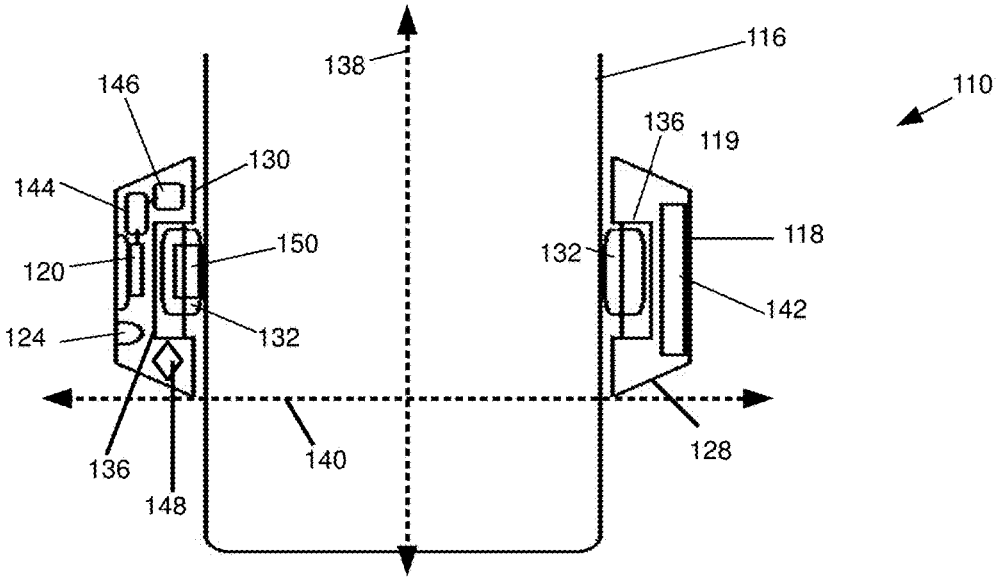
FIG. 5 is a cross-section view of a liquid measuring device in accordance with principles of the invention.

FIG. 5 shows a cross-section of the liquid measuring device 110 and it's interior components. The liquid measuring device 110 has an exterior defined by the outer wall 118, the beveled upper wall 119, and a beveled lower wall 128. The interior side 130 of the liquid measuring device 110 includes an annular ring 132 configured to form a friction fit with the outside wall 134 of the bottle 116. The annular ring 132 may be continuous or discontinuous and is a component of a scale 136 that measures force in a direction 138 transverse to the plane 140 defined by the liquid measuring device 110. The device 110 also includes a battery 142, a microcontroller 144, an accelerometer 146, a wireless transmitter 148 and a temperature sensor 150. In this embodiment, the wireless transmitter 148 is a Bluetooth® transmitter and the temperature sensor 150 is located within the annular ring 132 so that it remains in contact with the bottle 116.

During use, the scale 136 measures the force exerted by the bottle in the direction 138 transverse to the measuring device 110. The accelerometer 146 measures the direction of gravity, thereby determining the orientation of the bottle 116. The microcontroller 144 uses this information to calculate the weight of the bottle 116 and its contents. Thus, the microcontroller 144 determines the weight, from which it can also deduce the volume of liquid within the bottle 116, which can be displayed on the self-illuminating digital display 120. The microcontroller 144 also transmits this information in real time via the wireless transmitter 148 to the electronic device 112 for display and recording. Similarly, the temperature of the bottle may be measured using the temperature sensor 150 and this information may be displayed on the digital display 120 and may also be transmitted to the electronic device 110 for display and recording.

An operator may designate an optimal temperature range and when the temperature is within that range, the green LED light 122 is illuminated. Conversely, when the temperature is outside the optimal range, the red LED light 124 is illuminated. An operator may also designate a desired amount of liquid to be consumed during a feeding. When the change in the amount of liquid within the bottle 116, as determined by the measuring device 110, reaches the desired amount, the green LED light flashes. During use, an operator may attach the measuring device 110 to an empty bottle and pick up the bottle holding only the measuring device 110. This allows the scale 136 to determine the empty weight of the bottle. The operator then fills the bottle with liquid such as baby formula and again holds the bottle up holding only the measuring device 110. This allows the device 110 to determine the weight, and thus total volume, held within the bottle. The device may also record the temperature of the liquid. If the liquid is within the correct temperature range, an operator may feed and infant from the bottle. The operator can monitor the amount of liquid consumed by an infant by viewing either the digital display 120 or the electronic device 112. Both of these options allow an operator to accurately measure the amount of liquid consumed by an infant without using any other light source. This allows an operator to feed and infant in the dark, thereby preventing an infant from becoming fully awake and aware. The operator continues to monitor the consumption of the liquid by the infant until a desired amount of liquid has been consumed. The green LED light 122 and/or the electronic device 112 may also signal when a predetermined volume of liquid has been consumed. Because the measuring device 110 is capable of measuring the liquid consumed in real time while the bottle is held and tilted downward, an operator does not need to remove the bottle from an infant's mouth, hold it up right and turn on a light to determine whether the infant has consumed a sufficient amount of liquid.

Figure 6:
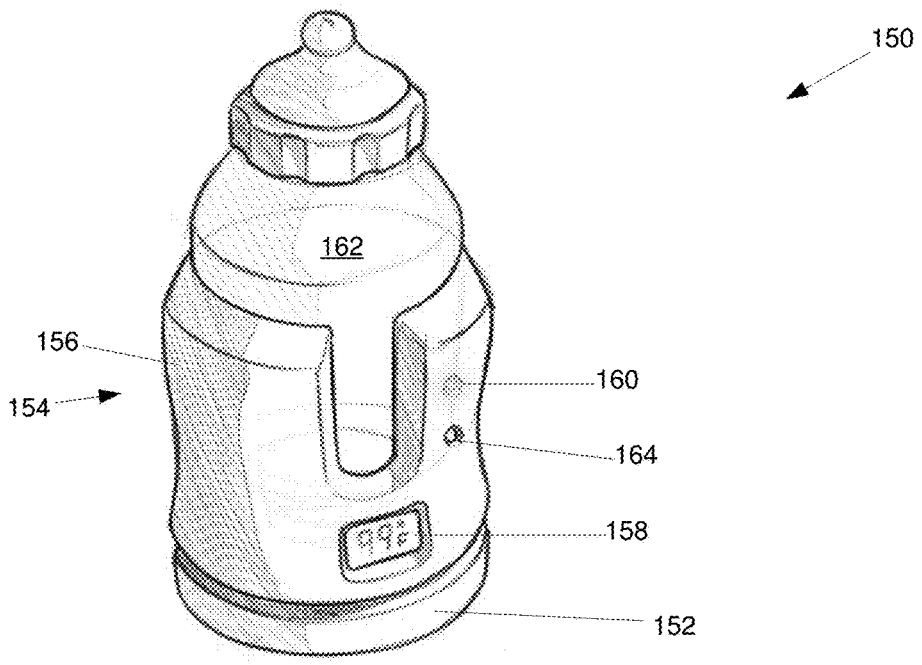
FIG. 6 is a perspective view of an alternative embodiment of a liquid measuring device in accordance with principles of the invention.
Figure 7:
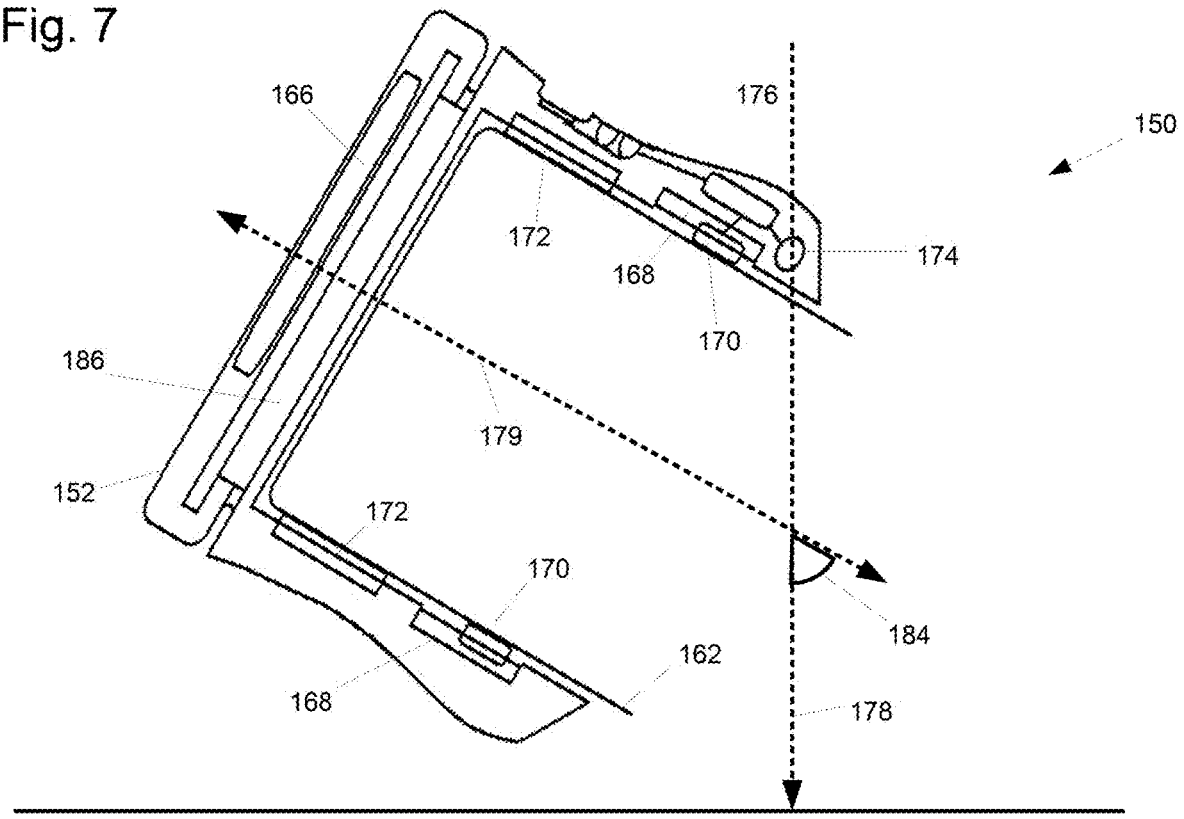
FIG. 7 is a cross-sectional view of an alternative embodiment of a liquid measuring device in accordance with the principles of the invention.

FIGS. 6 and 7 show an alternative embodiment of a liquid measuring device 150 for a baby bottle in accordance with principles of the invention. The liquid measuring device has a base 152 and a sleeve 154 extending upward. In this embodiment, the sleeve 154 has a curved outer wall 156 ergonomically configured to be comfortably held by a human hand. A self-illuminating digital display 158 displays the temperature and/or remaining amount of liquid within the bottle and/or the amount of liquid consumed during a feeding session. A green LED light 160 is illuminated when the temperature of the liquid within the bottle 162 is within a predetermined optimal range. The control button 164 allows an operator to cycle through various readings on the digital display 158. For example, pressing and holding the button 164 down for three seconds may turn on or off the device. Rapidly pushing the button 164 allows the operator to cycle between temperature in degrees Fahrenheit, temperature in degrees Celsius, and the amount of liquid consumed during a feeding.

FIG. 7 is a cross-section of the liquid measuring device 150 and a bottle 162, showing the internal components. The measuring device 150 has a battery 166 housed within its base 152. The device 150 also has a scale 168 having an annular ring 170 forming a friction fit with the bottle 162. An annular temperature sensor 172 measures the temperature of the bottle and the liquid it holds. An accelerometer 174 allows the microcontroller 176 to determine the amount of liquid within the bottle 162. During feeding, the accelerometer 174 allows the microcontroller 176 to determine the direction of gravity 178 relative to the direction 180 of the force measured by the scale 168. Those skilled in the art will appreciate that the force of gravity exerted upon the bottle 162 may be calculated by multiplying the force measured by the scale 168 by the cosine of the angle 184 between the direction of gravity 178 and the direction of the force 179 measured by the scale 168. This is the same technique employed by all of the exemplary devices of the invention. In this embodiment, the base 152 includes a second scale 186 that measures the weight of the bottle when the measuring device 150 is placed in the upright position shown in FIG. 6. The inclusion of the second scale 186 allows an operator to verify the accuracy of the change in amount of liquid calculated by the microcontroller 176.

The liquid measuring device 150 has a microcontroller 176 that performs simpler, less sophisticated calculations. The microcontroller 176 only records the change in amount of liquid within the bottle during a feeding. As a result, it is unnecessary to "tare" the scales by measuring the empty weight of the bottle. This embodiment also includes a longitudinal open groove 190 in the measuring device 150 that allows an operator to visually observe the level of the liquid within the bottle when it is placed upright as shown in FIG. 6.

Figure 8:
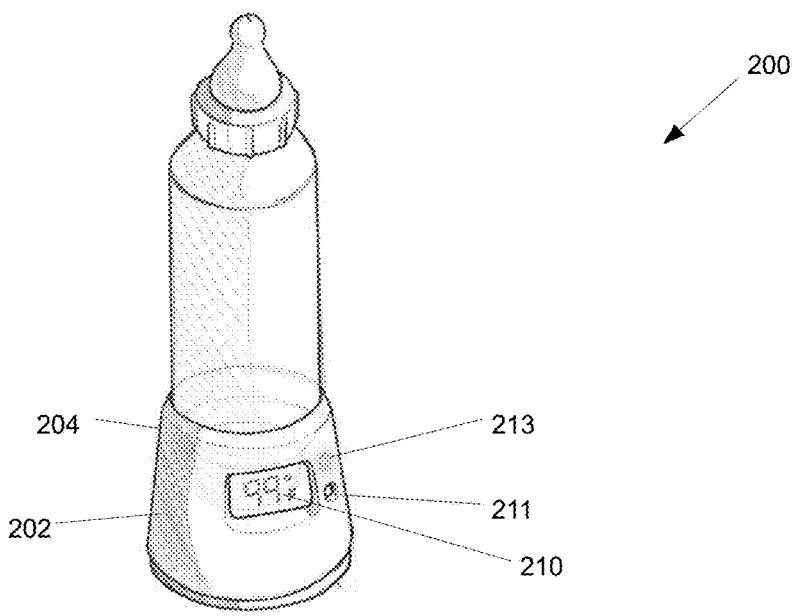
FIG. 8 is a perspective view of another alternative embodiment of a liquid measuring device in accordance with principles of the invention.
Figure 9:
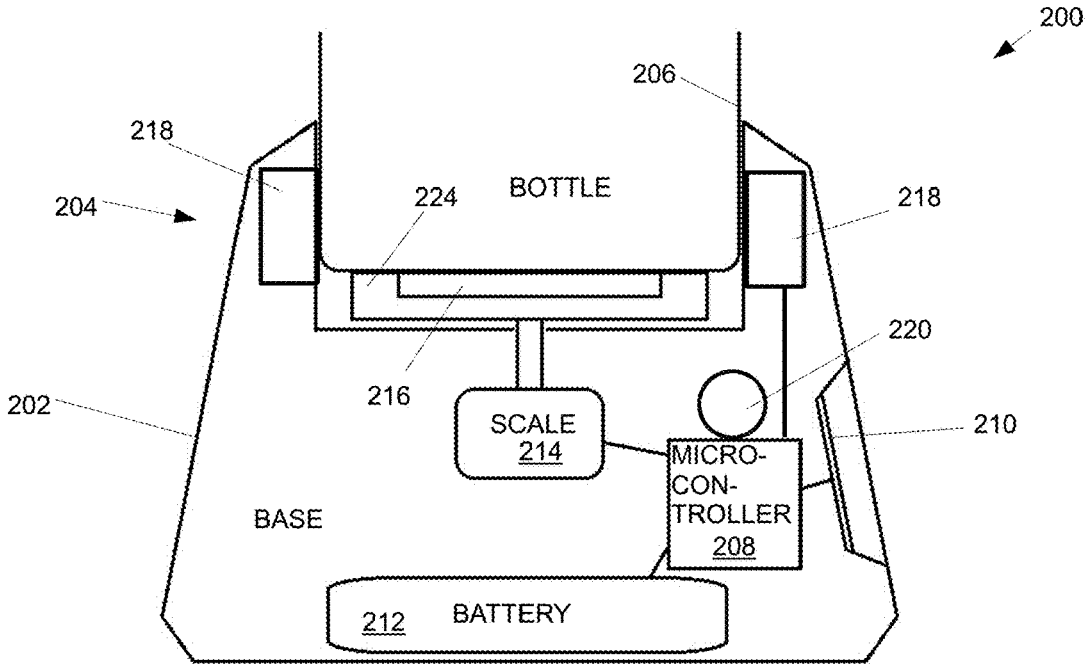
FIG. 9 is a cross-sectional view of another alternative embodiment of a liquid measuring device in accordance with principles of the invention.

FIGS. 8 and 9 show another alternative embodiment of a liquid measuring device 200 for a baby bottle in accordance with the principles of the invention. In this embodiment, the liquid measuring device 200 has a larger base 202 and a relatively short sleeve 204 that only covers a small portion of the bottom of the bottle 206. The measuring device 200 includes a microcontroller 208 in communication with a self-illuminating display 210, a battery 212, a scale 214, a temperature sensor 216 located within the scale 214, a heating element 218, in this embodiment the heating element is annular, and an accelerometer 220. A control button 211 is used to change what information is provided by the display 210. A green LED light 213 illuminates when the bottle 206 is within a predetermined temperature range.

As with the other devices disclosed herein, the microcontroller 208 calculates the remaining amount of liquid or the change in amount of liquid using information provided by the accelerometer 220 and the scale 214. The display 210 is used to display the temperature detected by the temperature sensor 216 and/or the remaining amount of liquid and/or the change in amount of liquid during a feeding. The microcontroller 208 also controls the heating element 218. When the microcontroller 208 detects that the temperature of the bottle 206 has fallen below a desired temperature, it activates the heating element to warm the bottle 206 until it reaches the desired temperature. This embodiment therefore includes the added functionality of heating the liquid with in a bottle 206. In addition, in this embodiment a piston 224, which is attached to the scale 214, is removably affixed to the bottom of the bottle 206, and the sleeved 204 does not form a friction fit with the bottle 206.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. A device for measuring a change in volume of a liquid in a baby bottle during feeding comprising:

a body comprising a sleeve extending over a baby bottle, the body having an open distal end, the sleeve being radially symmetric about a longitudinal axis, wherein the sleeve does not form a friction fit with the bottle;

a scale having an annular ring on the interior side of the sleeve frictionally engaged with an outside wall of the baby bottle, the scale measuring a force exerted in a distal direction along the longitudinal axis by the bottle within the sleeve during feeding;

an accelerometer determining a direction of gravity and measuring an angle between the longitudinal axis and the direction of gravity during feeding;

a self-illuminating display screen;

a battery; and, a microcircuit in communication with the scale, the accelerometer, the display screen and the battery.

2. The device for measuring a change in volume of a liquid in a baby bottle during feeding of claim 1 further comprising a temperature gauge in the annular ring of the scale.

3. The device for measuring a change in volume of a liquid in a baby bottle during feeding of claim 1 further comprising a planar base at a proximal end of the sleeve.

4. The device for measuring a change in volume of a liquid in a baby bottle during feeding of claim 3 further comprising a second scale in the base capable of measuring a weight of the baby bottle when the device is resting on the base.

5. A method for measuring an amount of fluid consumed by an infant comprising the steps of:

providing a device comprising a sleeve that extends around a baby bottle and being radially symmetric about a longitudinal axis, wherein the sleeve does not form a friction fit with the bottle, wherein the device has a battery, a microcircuit, a scale including an annular ring forming a friction fit with the baby bottle, the scale measuring force exerted by the bottle in the longitudinal direction and an accelerometer measuring the direction of gravity and the angle between the direction of gravity and the longitudinal direction;

placing the device around a baby bottle;

filling the baby bottle with a liquid;

feeding an infant from the bottle;

while feeding the infant from the bottle, measuring the change in a force in the longitudinal direction;

measuring the angle between the direction of gravity and the longitudinal direction, simultaneous with the step of measuring the change in force in the longitudinal direction;

calculating the change in mass of the liquid.

6. The method for measuring an amount of fluid consumed by an infant of claim 5 further comprising displaying the change in mass of the liquid on a self-illuminating display screen on the sleeve of the device.

7. The method for measuring an amount of fluid consumed by an infant of claim 6 wherein the device provided includes a temperature gauge capable of measuring a temperature of the liquid, and further comprising:

measuring the temperature of the liquid in the baby bottle;

illuminating a green light on the device when the temperature of the liquid is within a predetermined range; and, illuminating a red light on the device when the temperature of the liquid is not within a predetermined range.

8. The method for measuring an amount of fluid consumed by an infant of claim 5 wherein the microcircuit records data comprising the change in mass of the liquid during a feeding session; and further comprising wirelessly transmitting data from the device to an electronic device and displaying the change in mass of the liquid on the electronic device.

9. The method for measuring an amount of fluid consumed by an infant of claim 8 wherein the device provided includes a temperature gauge capable of measuring a temperature of the liquid, and further comprising:

measuring the temperature of the liquid in the baby bottle;

wirelessly transmitting the measured temperature of the liquid to the electronic device; and, displaying the temperature of the liquid on the electronic device.

10. The method for measuring an amount of fluid consumed by an infant of claim 8 further comprising the step of recording a total change in mass of the liquid during the feeding, and the step of repeating the steps over a period of time, and recording the mass of liquid consumed and time intervals between each feeding, thereby creating a log documenting the feeding of the infant over a period of time.

* * * * *